US005271670A

United States Patent [19]

Grabher

[11] Patent Number: 5,271,670

[45] Date of Patent: Dec. 21, 1993

[54] FURNITURE CONNECTOR FOR CONNECTING FURNITURE PARTS

[75] Inventor: Günther Grabher, Fussach, Austria

[73] Assignee: Grass AG, Hochst/Vlbg., Austria

[21] Appl. No.: 902,926

[22] Filed: Jun. 23, 1992

[30] Foreign Application Priority Data

Jun. 26, 1991 [DE] Fed. Rep. of Germany ... 9107835[U]
Aug. 9, 1991 [DE] Fed. Rep. of Germany ... 9109861[U]

[51] Int. Cl.[5] ..... A47B 95/00

[52] U.S. Cl. ..... 312/348.1; 16/257; 16/272; 16/DIG. 43

[58] Field of Search ..... 312/348.1; 403/331, 403/292, 294, 286, 188, 325, 321; 52/127.7, 127.9; 16/257, 271, 272, DIG. 43

[56] References Cited

U.S. PATENT DOCUMENTS 2,692,054 10/1954 Berglund ..... 248/221.4
3,760,547 9/1973 Brenneman ..... 403/292
4,188,685 2/1980 Röck et al. ..... 16/DIG. 43
4,680,830 7/1987 Röck et al. ..... 16/DIG. 43
4,839,940 6/1989 Grass ..... 16/DIG. 43
4,881,297 11/1989 Grass ..... 16/DIG. 43
4,888,853 12/1989 Röck et al. ..... 16/DIG. 43
5,056,190 10/1991 Röck et al. ..... 16/257
5,159,740 11/1992 Brustle et al. ..... 16/DIG. 43

FOREIGN PATENT DOCUMENTS 3119571 12/1982 Fed. Rep. of Germany .... 16/DIG. 43

*Primary Examiner*—Kenneth J. Dorner
*Assistant Examiner*—Janet M. Long

[57] ABSTRACT

A furniture connector for connecting furniture parts is used for the attachment of a hinge arm on a body part or also for attaching a drawer front to a drawer side wall. In this case one part of the fixture is provided with a slide-in opening respectively for the arms pointing forward in the slide-in direction of the other part of the fixture, and one part of the fixture has a spring element which engages in a snap-in recess of the other part of the fixture when the parts of the fixture are assembled and interengaged.

11 Claims, 5 Drawing Sheets

FURNITURE CONNECTOR FOR CONNECTING FURNITURE PARTS

BACKGROUND OF THE INVENTION

1. Field of the Invention

The subject of the present innovation is a furniture connector.

2. Description of the Related Art

Furniture connectors of this type have hitherto been known only for connecting furniture parts, in particular parts of a wardrobe. However, a fast and also reliable assembly is not possible with these.

In particular, this, suffers from the drawback that the furniture fixtures of such furniture connections protrude beyond the surface of the furniture item and it is therefore not possible to transport and stack the items of furniture containing such fixtures.

OBJECTIVES AND SUMMARY OF THE INVENTION

It is therefore the object present innovation to develop a furniture connector of the type mentioned at the beginning in such a way as to provide a simple, releasable connection between the fixtures of the furniture connector in which at the same time at least one of the fixtures does not protrude over the surface of the furniture.

This object is achieved through the technical teaching of the present invention.

The essential feature of the present innovation is that the furniture connector according to the innovation can be used both as a fixture for the furniture hinges as well as a fixture for use in the assembly of drawers.

In the embodiment as furniture fixture for hinge fitting according to the present innovation the technical teaching results in special advantages.

The invention is a releasably connectable fixture one part of which has slide-in openings which engage arms directed in the slide-in direction. The other part of the fixture insures that a highly stressed connection is achieved between fixture parts. The arrangement of a spring element in one part of the fixture, which can be connected in a snap-in fashion to the other part of the fixture, has the advantage that the connection can be easily released.

Within the context of the present innovation general protection is therefore sought for the creation of slide-in openings in one part of the fixture. In a first embodiment, these slide-in openings can be arranged in the area of the dowel elements which in turn may be countersunk into the surface of the furniture, e.g. in the body wall or the drawer front. This achieves the object mentioned at the beginning, namely that one part of the fixture, which defines the slide-in openings, is attached in countersunk manner in the surface of the furniture. In this way the items of furniture can be readily transported and stacked on top of each other without the danger of the countersunk fixture arranged in a furniture item damaging the other item of furniture stacked on top of it.

Initially it is irrelevant in which direction and in which plane the slide-in openings are constructed. There are several possibilities for this. In a first embodiment provision is made for the hinge arm to be provided with a support bracket with forward pointing arms which engage in associated slide-in openings in the body and wherein the spring element is secured to the support bracket as a bending spring, clamped at one end, which engages with a snap-in projection in an associated snap-in recess of the body.

In a first embodiment example the forward pointing arms may also be bent downwards and forwards, an angle in the range of approximately 10°-50° being preferred.

In another embodiment example the forward pointing aims are directed parallel to the furniture surface. A precondition in this case is that the slide-in openings are arranged above the furniture surface in order to allow engagement by the forward pointing arms which are directed parallel to the furniture.

In this embodiment example it is preferred if the slide-in openings are formed as a fixture of pocket-shaped tongues bent from the material of the base plate.

In another embodiment example the base plate is preferably made by diecasting and in this case the tongues are produced by casting.

The slide-in openings in this case can be arranged in alignment one behind the other in the slide-in direction or in another embodiment example the slide-in openings can be arranged side by side in the slide-in direction along a line extending perpendicular to the slide-in direction.

When using the furniture connector as a drawer fixture, it is preferable if one part of the fixture is secured to the front side of the drawer side wall and the other part of the fixture is locked to the part of the fixture arranged on the inside of the drawer front panel.

This embodiment example therefore provides a particularly simple and releasable connection between he drawer front panel and a side wall of the drawer. In all the embodiment examples provision is additionally made for the parts of the fixtures defining the slide-in openings to be adjustable in all three dimensions, so as to allow the fixture to adapt to the special assembly situation.

All the details and features disclosed in the documents—including the abstract—are claimed as essential to the invention in so far as they are novel with respect to the state of the art, either individually or in combination.

The innovation is now explained in more detail with the aid of several embodiment examples as shown in the drawings. From the drawings and their description can be seen further essential features and advantages of the innovation.

DESCRIPTION OF THE PREFERRED EMBODIMENTS

Figure 1:
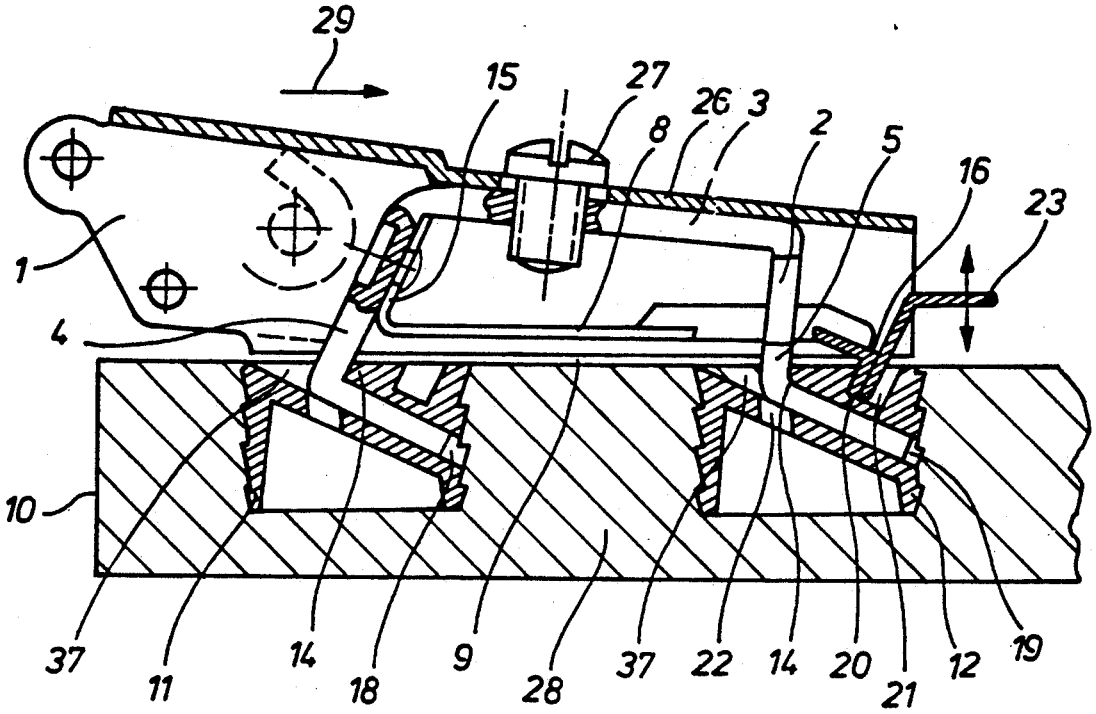
FIG. 1: a section through a furniture connector according to the innovation of the embodiment as a hinge fixture.

FIG. 1 shows the entire arrangement of the hinge parts on the body side, partly shown in section. A support bracket 2 according to the innovation has mounted on it the hinge arm 1 in the form of a support bracket 2 embracing cover bracket 26 which, through a screw connection 27 or the like, is adjustably secured to the support bracket centre part 3.

Figure 2:
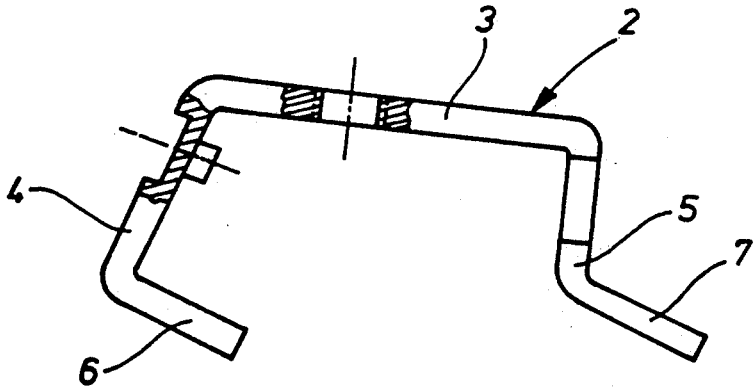
FIG. 2: a side view of the support bracket according to FIG. 1.
Figure 3:
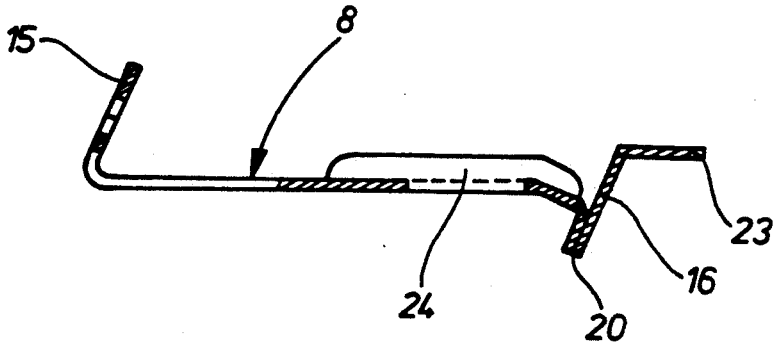
FIG. 3: a side view and partly in section of the spring element according to FIG. 1.
Figure 7:
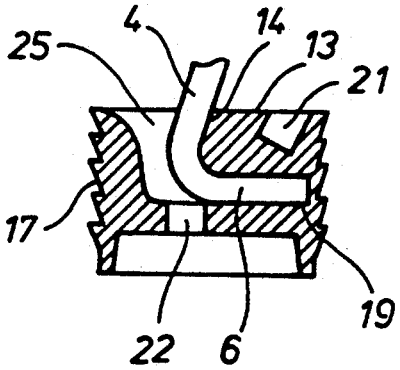
FIG. 7: a section through a dowel element of a second embodiment example.

In FIG. 2 is shown a preferred embodiment of a support bracket 2 whose arms 4,5 are bent downwards by the arm centre part 3 which serves as the support for the cover bracket 26. The end regions 6,7 of these arms 4,5 are bent inwards from the body front edge 10 for engagement in securing elements on the body side, as shown in FIGS. 1,2 and 7.

According to this innovation, on the body side are provided dowel elements 11,12 which are secured in drillings of the wall of the furniture item—as shown in FIG. 1—and whose top end 13 on the body side is flush with the abutment or securing surface 9. These dowel elements 11,12 contain receiving slots 18,19 in which the end regions 6,7 of the support bracket arms 4,5 are received in a form-locking manner.

Figure 4:
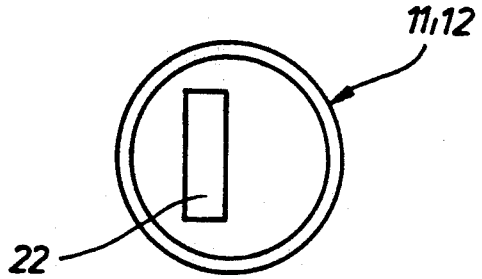
FIG. 4: a bottom view of the dowel element according to FIG. 1.
Figure 5:
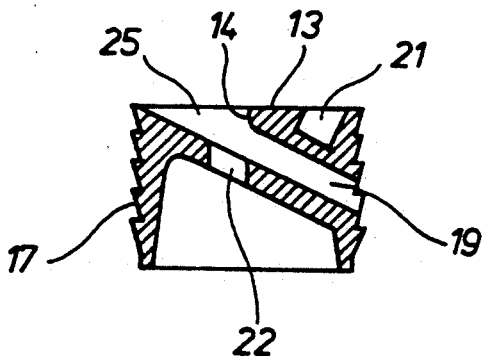
FIG. 5: a section through the dowel element according to FIG. 4.
Figure 6:
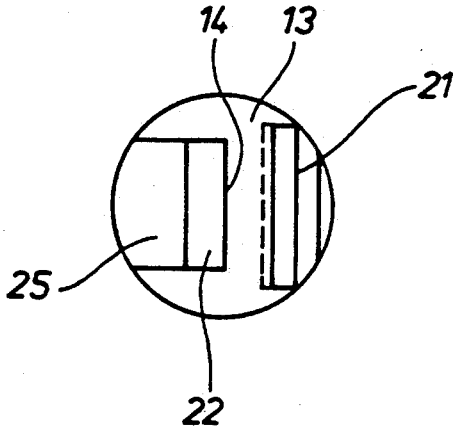
FIG. 6 a plan view of a dowel element according to FIG. 4.

In FIGS. 4 to 7 are shown two of the preferred embodiments of such countersunk dowel elements set in the wall of the body 28. The FIGS. 4 to 6 show a dowel element 11, 12 in which the receiving slot 18,19 is arranged in the snap-in direction to correspond to the arm end regions 6,7 of the support bracket 2 sloping inwards and downwards at an angle of approximately 20°–40°. The embodiment example shown in FIG. 7 has a receiving slot 19, running almost parallel to the dowel top end 13, for correspondingly angled end regions 6,7 of the support bracket arms 4,5.

For securing each of the two dowel elements 11,12 in the drillings provided in the body 28 at the correct angle in relation to the front edge 10 of the body 28, slot-shaped assembly receptacles 22 are formed along the longitudinal axis of the dowel 11, 12 which receive a correspondingly designed centering part of a tool for press-inting the dowel elements 11,12 either by machine or manually. In the dowel embodiments shown in FIGS. 1 and 41 these assembly receptacles 22 are preferably constructed as continuous slots which open into the bottom chamber of the dowel element. This slot-shaped assembly receptacle 22 is formed in a position beneath the receiving slot 19 which enables the engagement of the tool part for setting the dowel elements 11,12 through the access opening 25 of the receiving slot 18,19 on the top side. The dowel elements 11,12 are furthermore provided with external ribs 17 on the body side for improved grip in the drillings.

With the use of the dowel elements specially designed for the snap-on securing on the body side and countersunk in the body, the abutment or securing surface 9 on the respective furniture part is free of protruding hinge parts, such as for example a base plate secured to the surface as part of the hinge elements on the body side. The furniture parts are therefore stackable for storage and transport without causing damage.

The snap-on attachment on the hinge arm 1 by the support brackets 2, adjustably secured via the cover bracket 26, is achieved merely by introducing the arm end regions 6,7 of the support bracket 2 into the receiving slots 19 on the dowel side, these slots 19 being designed to correspond to the profile of the end regions 6,7. The transition from receiving, slot 19 to the top side 13 of the respective dowel element 11,12 serves as abutment 14 for the arm 4 or 5 and is shaped to correspond to the angled transition to the end region 6,7, as shown for one embodiment example in FIGS. 1 and 5 and in FIG. 7 for the other embodiment example of a dowel element 11,12.

The form-locking engagement of the arm end regions 6,7 in the receiving slots 18,19 and the corresponding shape of the support bracket 2 ensures that the hinge arm 1 is secured in position on the body side via the support bracket 2 in the dowel elements 11,12 according to the innovation.

For locking the support bracket 2 in the secured position of the body 28 according to the innovation the support bracket 2 is provided with a spring bond steel spring element 8 which, as shown in FIGS. 1 and 2, in the preferred embodiment is secured with one end 15 on the inside of the support bracket arm 4 nearest the front edge of the body 10 and with the other end 16, penetrating the other support bracket arm 5 is bent downwards in the form of a snap-in projection 20. The length of this spring element 8 is so designed that in the secured position of the support bracket 2 the snap-in projection 20 can snap into a recess 21 arranged in the rear dowel element 12 and can thus lock the support bracket 2 in this end position. A stiffening element 24 supporting the snap-in operation in this embodiment is preferably provided in the rear part of the spring element B. on the end of the snap-in projection 20, an operating lever 23 is bent off, which enables unlocking and thus a very simple removal of the hinge part from the body side.

From the aforementioned description can be seen that a hinge arm can be secured in a very simple manner on the body side by the support bracket 2 of the innovation in cooperation with the dowel elements 11,12 specially constructed for securing a snap-in position, wherein the abutment or attachment surfaces 9 on the body 28 are free from protruding parts or fixing elements and the furniture parts can thus be safely stacked for transportation and storage.

In FIGS. 8 to 12 is shown a further embodiment example of the present innovation according to which the arms 4,5, on the support bracket 2, which are forwardly directed in the slide-in direction 29, do not necessarily have to be downwardly inclined, but can also be directed parallel to the surface of the furniture.

Figure 8:
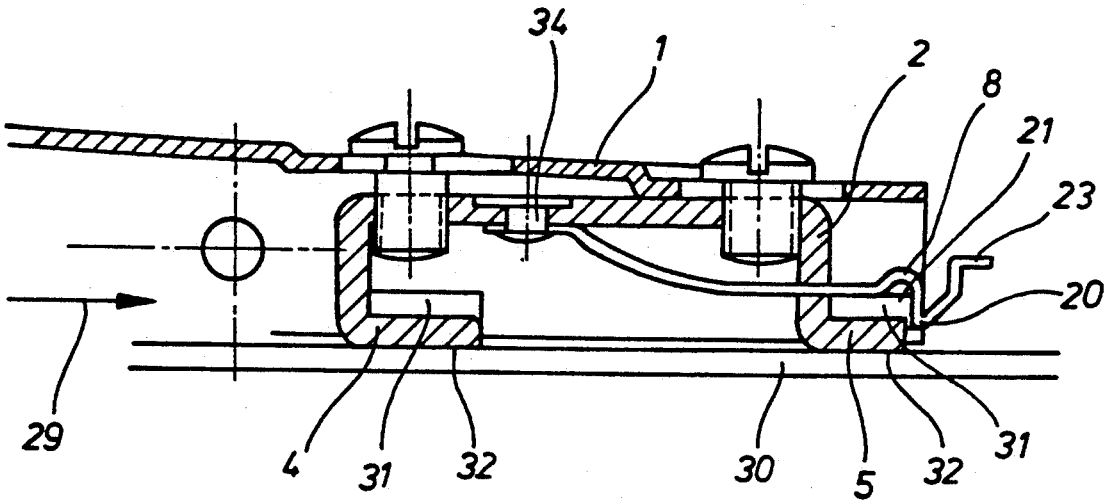
FIG. 8: a section through a second embodiment example of a hinge fixture.
Figure 9:
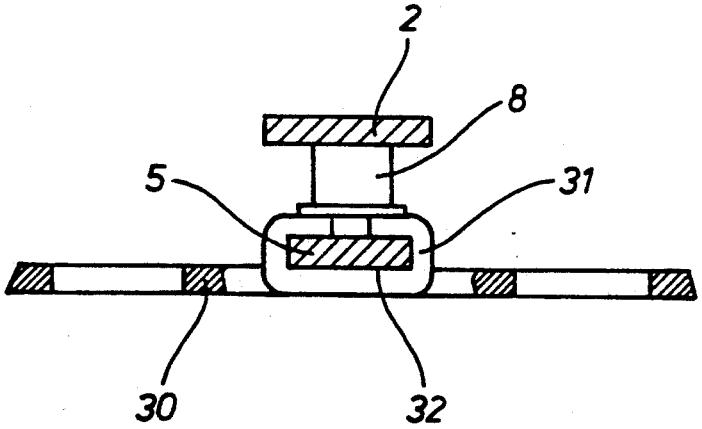
FIG. 9: a cross-section through an arrangement according to FIG. 8 at the level of a slide-in opening.
Figure 10:
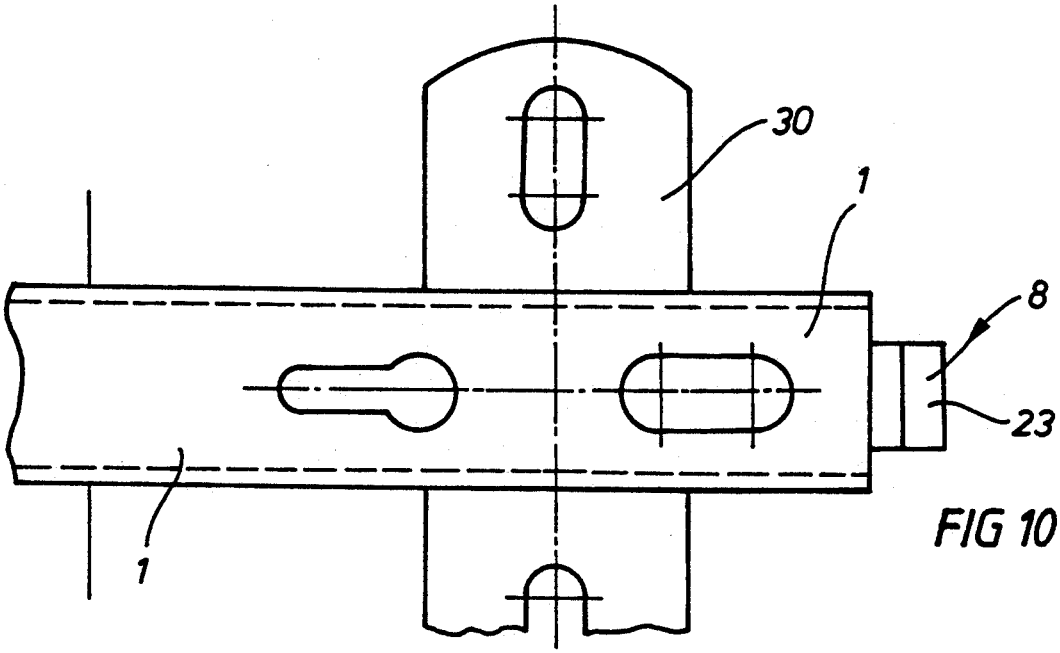
FIG. 10: the plan view of an arrangement according to FIG. 8.
Figure 11:
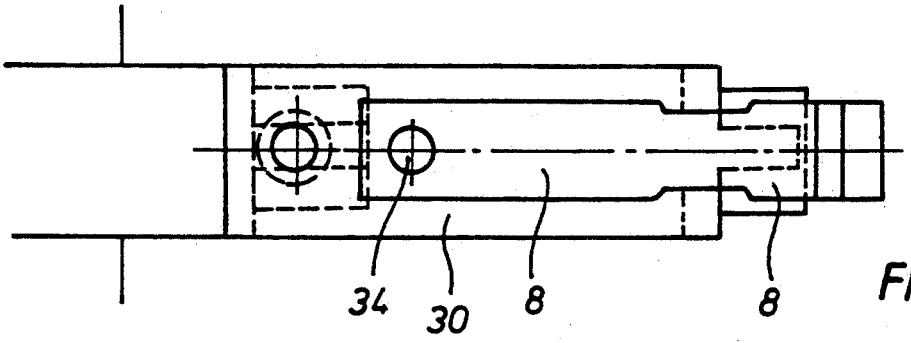
FIG. 11: the plan view of the arrangement according to FIG. 8 with the hinge arm omitted.
Figure 12:
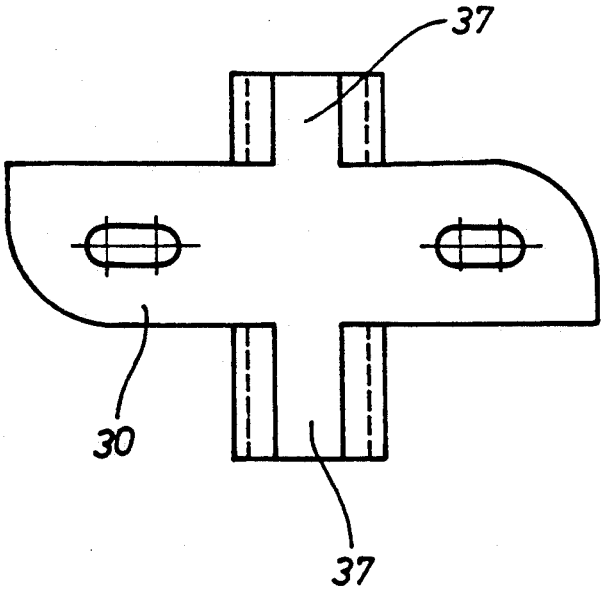
FIG. 12: plan view of the base plate.

For this purpose, pocket-like tongues 31 are punched from the base plate 30 and pressed upwards out of the material of this base plate 30 to form slide-in openings 32 for engagement by the arms 4,5 of the support bracket 2—according to FIG. 8.

According to FIG. 8 of the embodiment shown, the arms 4,5 of the support bracket are arranged in alignment one behind the other. However for achieving the object this is not strictly necessary; in another embodiment example the arms 4,5 may be arranged side by side and consequently also the tongues 31 which are then located along One line which preferably extends perpendicularly to the slide-in direction 29.

Otherwise the same explanations apply as in the previous embodiment examples for FIGS. 1 to 6.

The fastening 34 of the spring element 8 can be effected by a rivet. In FIG. 8 and 1 the fastening element may be punched out of the bracket.

Figure 13:
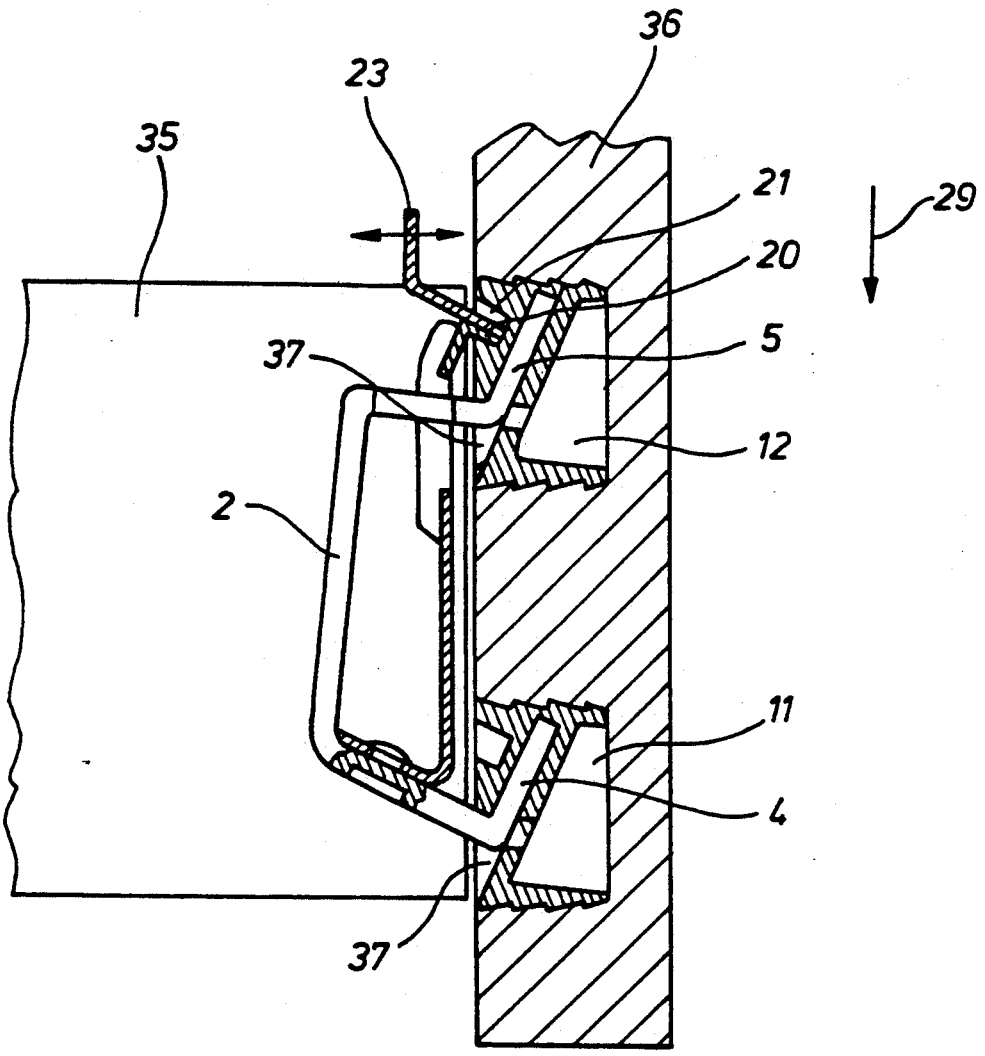
FIG. 13: section through a furniture connector in the embodiment of a drawer fixture.

The FIG. 13 shows an embodiment of a furniture connector according to the innovation in the form of a drawer connector.

In this case a front panel 36 is releasably attached to the side wall 35 of a drawer with the aid of a furniture connector as described in the aforementioned.

The inside of the front panel 36 in this case is provided with dowel elements 11,12 with associated slide-in openings 37.

The forward front end of the respective side wall 35 in this case holds the other fixture, comprising a support bracket 2, which is countersunk in the side wall.

Only the forward slanting angled arms 4,5 now still project from the forward front face of the side wall 35.

This connection can be easily released, because for securing a front panel 36 to the side walls 35 of a drawer this only has to be pushed from above onto the arms 4,5 in the slide-in direction 29, so that the arms 4,5 penetrate the associated slide-in openings 37 of the dowel elements 11, 12.

The entire connection is self-locking, i.e. after the completed fastening the spring element 8 automatically snaps into place as a result of the fact that snap-in projection 20 snaps into the associated snap-in recess 21 in the upper dowel element 12.

REFERENCES USED IN THE DRAWINGS

1—Hinge arm
2—Support bracket
3—Centre part of 2
4—Arm of 2 front
5—Arm of 2 rear
6—End region of 4
7—End region of 5
8—Spring element / leaf spring
9—Abutment-/attachment surface
10—Body front edge
11—Dowel element
12—Dowel element
13—Top side of dowel
14—Abutment
15—End of spring front
16—End of spring rear
17—Continuous ribs, dowel
18—Receiving slot in 11
19—Receiving slot in 12
20—Snap-in Projection
21—Snap-in recess in 11/12
22—Assembly receptacle
23—Operating lever
24—Stiffening element 8
25—Access opening in 11/12
26—cover bracket
27—Screw connection
28—Body
29—Slide-in direction
30—Base plate
31—Tongues
32—Slide-in opening
34—Fastening
35—Side wall
36—Front plate
37—Slide-in opening

I claim:

1. Furniture connector for connecting furniture parts, especially for connecting to a body part hinge arm which is pivotally connected to a door part or for connecting a drawer front to a drawer side wall, comprising a first fixture mounted on one furniture part and a second fixture mounted on a second furniture part, the first fixture including a support bracket having first and second engaging regions and means for securment to the first furniture part, a spring having a snap-in projection and an operating lever, and means securing the bracket to the spring; and a second fixture, with a top surface parallel to the furniture part, including at least two dowels downwardly adapted to receive the first and second bracket engaging regions and having inclined receiving slots extending from and being included with respect to said top surface.

2. Furniture connector according to claim 1 wherein the receiving slots are arranged in alignment one behind the other.

3. Furniture connector according to claim 2 wherein the spring snap-in projection has an associated unlocking lever for releasing a joined first and second fixture.

4. Furniture connector according to claim 3 wherein the spring is made of spring band steel.

5. Furniture connector according to claim 1 wherein the receiving slots are arranged in alignment side by side.

6. Furniture connector according to claim 3 wherein the spring snap-in projection has an associated unlocking lever for releasing a joined first and second fixture.

7. Furniture connector according to claim 6 wherein the spring is made of spring bond steel.

8. Furniture connector according to claim 7 wherein the spring has a stiffening element.

9. Furniture connector according to claim 1 wherein the spring snap-in projection has an associated unlocking lever for releasing a joined first and second fixture.

10. Furniture connector according to claim 1 wherein the spring is made of spring band steel.

11. Furniture connector according to claim 1 wherein the spring has a stiffening element.

* * * * *